US005488933A

United States Patent [19]

Pham

[11] Patent Number: 5,488,933

[45] Date of Patent: Feb. 6, 1996

[54] FUEL SUPPLY SYSTEM FOR MINIATURE ENGINES

[76] Inventor: Roger N. C. Pham, 5613 96th St., Lubbock, Tex. 79424

[21] Appl. No.: 195,441

[22] Filed: Feb. 14, 1994

[51] Int. Cl.[6] ..... F02M 23/00

[52] U.S. Cl. ..... 123/531; 123/676; 123/DIG. 3

[58] Field of Search ..... 123/676, 531, 123/DIG. 3, 393, 533, 535

[56] References Cited

U.S. PATENT DOCUMENTS

| | | | |
|---|---|---|---|
| 2,138,301 | 11/1938 | Howie | 123/DIG. 3 |
| 2,391,380 | 12/1945 | Barker | 123/DIG. 3 |
| 2,404,833 | 7/1946 | Forster | 123/DIG. 3 |
| 2,445,715 | 7/1948 | Jennings | 123/DIG. 3 |
| 2,463,933 | 3/1949 | Adkins | 123/DIG. 3 |
| 2,764,139 | 9/1956 | Gordon | 123/DIG. 3 |
| 3,734,072 | 5/1973 | Yamda | 123/DIG. 3 |
| 3,980,067 | 9/1976 | Remington | 123/DIG. 3 |
| 5,215,068 | 6/1993 | Kato | 123/676 |
| 5,239,965 | 8/1993 | Ninomiya | 123/676 |

FOREIGN PATENT DOCUMENTS

| | | | |
|---|---|---|---|
| 910366 | 4/1945 | France | 123/DIG. 3 |

*Primary Examiner*—Raymond A. Nelli

[57] ABSTRACT

Exhaust pressure of an air-cooled miniature internal combustion engine is used for fuel metering and fuel delivery to the engine under higher pressure than previously obtainable from muffler back-pressure in the prior art even though the back-pressure in the exhaust system is kept to near zero for maximum engine power and cooling. This is accomplished by tapping on to the engine's exhaust stream right at and facing the exhaust port. As the engine unloads, the muffler's exhaust is further aspirated outward by a faster-moving cooling airstream hence a further reduction muffler's back-pressure causing a decrease in fuel pressurization thus a decrease in fuel flow to the engine in corresponding with a known decrease in fuel requirement at high speed as it unloads, and vice-versa. Special fuel tanks designs for this fuel system are disclosed, as well as additional means for further boosting fuel pressure.

16 Claims, 12 Drawing Sheets

27
32
26
23b
24a
25
24b
28
23a 23a
28
24b
23b
27
32

29
30
32
23a
23b 27
32
26
28
23b
23a 27
31
28
33

28
31
26
38
27

FUEL SUPPLY SYSTEM FOR MINIATURE ENGINES

BACKGROUND OF THE INVENTION

1. Field of the Invention

In general, this invention relates to a fuel delivery system for miniature internal combustion engines, more particularly for model aircraft, comprising: a fuel tank which is sealed off against atmosphere and has at least two lines connected to the engine; one line is a fuel outlet line connected to the engine's carburetor and the other line is a pressurization/venting line connected to the engine's exhaust system whereby pressure from the engine's exhaust is the primary motive force supplying fuel to the engine.

More particularly, the exhaust pressure of each engine stroke cycle in combination with the frequency of said cycle also serve as means for metering precise amount of fuel required by the engine for maximum power and consistency.

2. Discussion of Prior Art

Referring to FIG. 1, a typical model airplane engine 3 is a single cylinder engine having a very simple carburetor 4 (of fixed bore single air intake venturi and non-variable fuel jet orifice at a constant throttle valve position, without a fuel bowl) for air and fuel intake and a very simple single-chamber expansion type of muffler 10 connected to the exhaust port for handling and muffling of exhaust gas. The air flow through the air intake venturi produces in the venturi throat a partial vacuum which draws fuel into the intake airstream from the engine fuel tank through the fuel jet. The carburetor has a throttle valve 4*a* which is adjustable to regulate air and fuel flow to the engine and thereby engine speed. It is well know in the art that venturi partial vacuum is rather weak, resulting in extremely unreliable engine operation due to variation in aircraft attitude in flight causing variation in fuel head pressure and also due to extremely high centrifugal forces imposed on the aircraft during aerobatic maneuvers, routinely exceeding ten times gravitational force.

The most common practice in response to this problem is to supplement carburetor's venturi fuel draw with pressurized fuel utilizing exhaust back-pressure from the muffler 10 via pressure ring nipple 12 placed on the muffler's expansion chamber 10*a*. Although this method allows more consistent engine operation, it is far from optimum.

Firstly, muffler back-pressure obtained from pressure fitting 12 as illustrated in FIG. 1 is generally not strong enough to prevent excessively lean or rich engine run during more forceful aerobatics, causing the engine to lose power or to quit abruptly thus potentially endangering the airplane and the public. Some engine manufacturers have placed the muffler pressure fitting nipple 12 directly on the muffler's inlet conduit 10*a* thus closer to the exhaust source, however, this proved to be not an improvement, and can be explained by the fact that exhaust gas velocity is very high (in the range of thousands of feet per second !) in the muffler inlet conduit 10*a*. Thus, according to Bernoulli's principle of fluids mechanics, this high flow velocity negate any pressure gain as the result of tapping closer to the exhaust source. Making the carburetor venturi smaller hence increasing the fuel draw will cause significant decrease in engine power. Increasing the muffler back-pressure by narrowing muffler tail pipe 14 will have the same effect, while at the same time causing significant increase in engine operating temperature.

Secondly, the conventional fuel delivery system, which is the aforementioned combination of venturi fuel draw and muffler back-pressure, does not produce optimum fuel metering for maximum power and fuel efficiency. (To truly achieve this requires the complexity of the automobile's carburetor, or a closed-loop feedback electronic fuel injection system). It is know in the art that unless a carburetor is of variable-venturi design (most carburetors are not), a doubling in the rate of air intake will cause a four-fold increase in venturi partial vacuum fuel draw. This means that at a constant degree of throttle opening in a model aircraft engine, as the engine increase in revolution per minute (rpm) during acceleration, a disproportionately higher amount of fuel than air will be drawn into the carburetor, causing a rich mixture thus inefficient operation, a decrease in torque and a limit on the engine power potential as it unloads when the engine gains speed as it unloads. Muffler exhaust back-pressure is better in that it varies in direct proportion to the engine's power output. Surprisingly, even if muffler's back-pressure is the sole motive force for fuel delivery, this still does not provide optimal fuel metering, as illustrated in FIG. 2. Referring to FIG. 2, the graph at the top depicts a typical two-stroke cycle glow ignition model airplane engine's power curve (at full throttle opening) as function of the engine's rpm as tested on the dynamometer. (These graphs represent typical engine testing data by miniature engine expert Mike Billington as published in *Model Airplane News* magazine periodically.) The graph in the middle shows the engine's fuel consumption (at full throttle opening) as function of engine rpm. It is very important to note that even though the engine's horse power (bhp) increases with increase in engine speed, there is a noticeable decrease in fuel consumption at higher engine speed after the torque peak at 11,500 rpm. This is most obvious in curve 1, which represents the engine being tested in open exhaust form, without muffler. This can also be seen in curve 2, representing the engine being tested with stock muffler. As shown in curve 2, peak fuel consumption occurs at 13,000 rpm and falls off noticeably with increase in rpm, while peak bhp occurs later at around 15,000 rpm with a decrease in fuel consumption. Therefore, the engine as tested in the dynamometer must have the needle valve 7 manually re-adjusted to decrease the needle valve's opening for peak power output every time the engine rpm is allowed to increase by reducing load. The carburetors needlevalve 7 is normally not adjustable in a model aircraft while in flight. And yet, the most efficient way to extract power is to have the engine at full throttle turning a large size propeller of low to medium pitch at the rpm of maximum torque while standing still (static rpm) in order to have good acceleration, and as the aircraft attained its maximum airspeed, the in-flight rpm should correspondingly increase to approach the maximum horsepower peak (this is because the propeller's pitch is fixed in a model aircraft). In curve 1, maximum torque (bottom graph) occurs at around 11,500 rpm and maximum horsepower occurs at around 18,000 rpm, or a ~50% increase in rpm due to engine unloading, for a maximum of 2.15 bhp (1.6 kw). However, actual in-flight engine measurements data by Dave Gierke as published regularly in *Model Airplane News* magazine for a number of engines have revealed that at full throttle, the in-flight rpm only increases by 5–10% over that of static rpm, using the conventional stock muffler setup as in FIG. 1*c*. Therefore, if the engine equipped with stock muffler for fuel pressurization is allowed to have a static rpm of 11,500 rpm as is the usual practice, then only 1.3 bhp (0.96 kw) is extracted from the engine while standing still, as shown in curve 2. However, as the engine unloads in flight an expected 10% over static rpm, to 12,650 rpm, the power extracted from the engine is not 1.45 bhp (1.07 kw) as predicted by curve 2, but actually may be equal to or slightly less than 1.3 bhp (0.96 kw) because as the engine unloads in-flight, its fuel-air mixture got richer than necessary for peak power, hence torque decreases and thus a decrease in bhp even with a slight rpm increase.

In real life operation, when the fuel pressure is relatively weak as is in the stock muffler pressure setup in FIG. 1*c*, the fuel-air mixture must be set richer than required for peak power to compensate for momentary leaning of the mixture in flight due to changing of fuel head pressure when climbing or diving, due to high centrifugal force in a tight turn or loop, or occasional air bubles in the fuel line, etc.. Without this richer-than-peak setting, then a momentary leaning of the mixture will cause a reduction in engine speed, which in turn creates a decrease in fuel delivery and further decrease in engine speed until the engine stops. On the other hand, the richer-than-peak setting will allow the engine speed to increase in response to momentary decrease in fuel supply, and with increase in engine speed comes stronger fuel draw thus allowing continous engine run. The price for a more stable engine run is a further reduction in the amount of power that can be extracted from the engine and poor fuel economy, which is not insignificant when model engine's fuel costs $10 to $15 a gallon. Curve 5 represents the same engine using stock muffler but with a richer-than-peak mixture setting sufficient for a stable engine run throughout aerobatic maneuvers. In the prior art, this problem is partially addressed in U.S. Pat. No. 4,731,992 by Krumscheid, which discloses a mechanism to increase the fuel pressure to the engine in response to a change of the aircraft from horizontal attitude to vertical attitude. Krumscheid's however, is not a complete fuel metering system, and provides no compensation for fuel-air mixture leaning due to centrifugal force or to air bubbles in fuel line or to dirts partially obstructing the fuel orifice in the carburetor. In U.S. Pat. No. 3,967,606 to Perry, a mechanical fuel pump is provided to supply fuel to the engine at a constant pre-set pressure without regard to engine speed by the use of a built-in pressure regulator and a diaphragmatic pump. Thus, Perry's pump can be expected to provide constant fuel supply during drastic changes in flight condition. But since Perry's pump (and all other fuel pump designs for model aircraft engine) cannot respond to variation in engine's fuel demand with varying in engine speed at a constant throttle opening, the pump does not allow for extraction of maximum power potential from the engine, inspite of its inherent considerable degree of complexity and manufacturing cost.

Referring again to FIG. 2, and by comparison of curve 1 (representing maximum power output from a model engine with optimum fuel metering running without muffler back-pressure) to curve 5 (representing actual power extractable from the same engine with stock fuel delivery system, stock muffler back-pressure and with a sufficiently rich mixture for reliability), it is clear that roughly 50% more power can be extracted from a model airplane engine if the following conditions can be met:

the engine must be run with a very free flowing exhaust system that has almost no exhaust back-pressure, the engine must have a fuel delivery system powerful enough that it is not measurably affected by drastic change in flight condition, even with the use of large-bore carburetor air intake venturi for increase power, and the fuel metering system must be able to deliver exact amount of fuel required for peak power at all engine speeds and throttle opening by means of adjustable feed-back mechanism.

In real life situation at present time, a 50% increase in power is most commonly obtained by increasing engine displacement by 50%, which is associated with usually tolerable increases in purchasing cost, engine weight, vibration level, and noise level; therefore, the following conditions must also be met:

the improved novel fuel and exhaust system must contribute significantly less increase in cost, in weight, in vibration level and no higher noise level than would an engine of larger displacement of comparable extractable power output.

SUMMARY AND OBJECTIVES OF THE INVENTION

It is a main objective of this invention to disclose a fuel delivery and metering system for miniature internal combustion engine, particularly for model aircraft that results in significant gain in power, fuel economy and that can meet all the aforestated conditions.

It is another objective of this invention to provide for a fuel delivery and metering system of miniature internal combustion engine that results in significantly more reliable engine operation than the prior art.

It is another objective of this invention to provide for a combination of fuel system and exhaust system for glow ignition miniature internal combustion engine that results in significantly cooler engine operation hence prolonged engine and glow plug life.

It is yet another objective of this invention to provide for a fuel system for two-stroke cycle miniature internal combustion engine that has an ability for self-priming at the engine's exhaust port immediately after fueling of the fuel tank, thereby resulting in very easy starting by hand even in cold weather, thus obviating the needs for cumbersome hand-held electrical starter.

It is yet another objective of this invention to provide for an exhaust system for two-stroke cycle model aircraft engine that can effectively direct the engine's hot oily exhaust away from the model aircraft, thereby preserving the aircraft structural integrity and exterior finishing, without causing the increase in muffler back-pressure as when a longer muffler tail pipe is used.

Further objects and advantages of this invention will become apparent from a consideration of the drawings and ensuing description.

In summary, this invention involves the use of exhaust pressure to deliver fuel to the engine under much higher pressure than previously obtainable from muffler back-pressure in the prior art even though the back-pressure in the exhaust system is kept to near zero for maximum engine power and cool operation. This is accomplished by tapping on to the engine's exhaust stream at a point as near the exhaust port as practically feasible and preferably facing the exhaust port, before the high pressure exhaust has a chance to expand or to accelerate in speed hence losing in pressure according to Bernoulli principle. When the model aircraft has attained high airspeed, the exhaust in the muffler is further aspirated outward by the moving airstream, hence a further reduction or even a negative muffler's average back-pressure, thus causing a decrease in fuel pressurization and therefore a decrease in fuel flow to the engine in keeping with a decrease in fuel consumption by the engine at high speed as it unloads. (FIG. 2, middle graph) Conversely, when climbing or maneuvering, the airspeed will decrease in accordance with the law of conservation of energy, causing less exhaust aspiration therefore increase in muffler pressure which in turn causes increase in fuel flow to the engine to satisfy the increase in fuel consumption at decreasing engine speed due to higher engine load. This increase in fuel flow can also prevent leaning of the fuel-air mixture thus preventing damaging engine overheating or detonation at higher engine torque load (lugging).

BRIEF DESCRIPTION OF THE DRAWINGS

FIG. 1*c* has a part of the engine cut away at line A–A'.

FIG. 3*a* has a part of the engine cut away at line C–C' on FIG. 3*b*. FIG. 3*b* has a part of the engine cut away at line B–B' on FIG. 3*a*.

FIG. 8*c* is a view of the cross-section along line D–D' of FIG. 8*b*.

DESCRIPTION OF THE PREFERRED EMBODIMENT

Figure 3B:
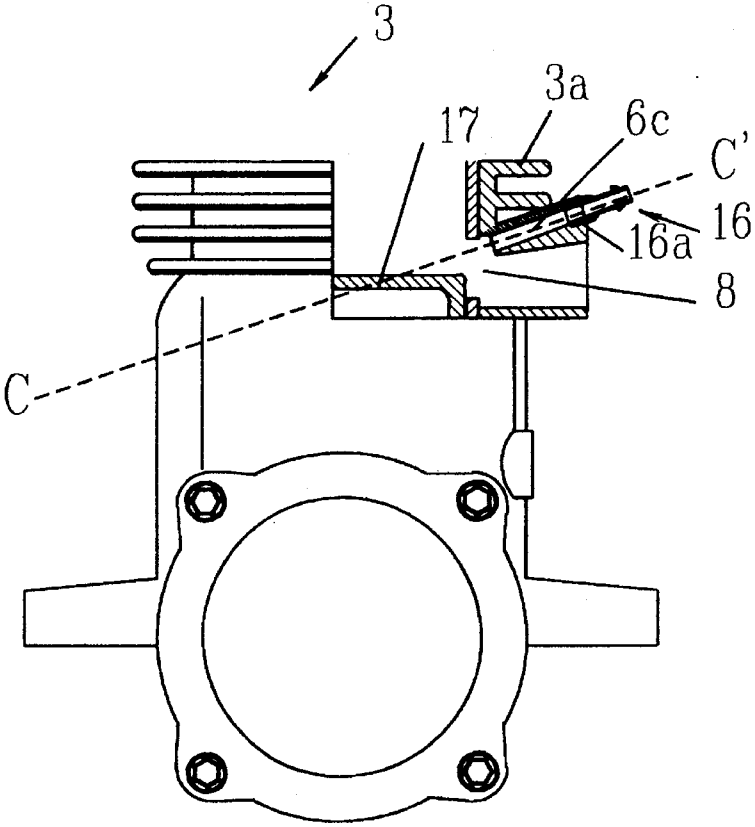
FIGS. 3*a* and 3*b* are top-down view and rear view respectively of a two-stroke miniature engine with the exhaust pressure tap fitting in place according to this invention.
Figure 3A:
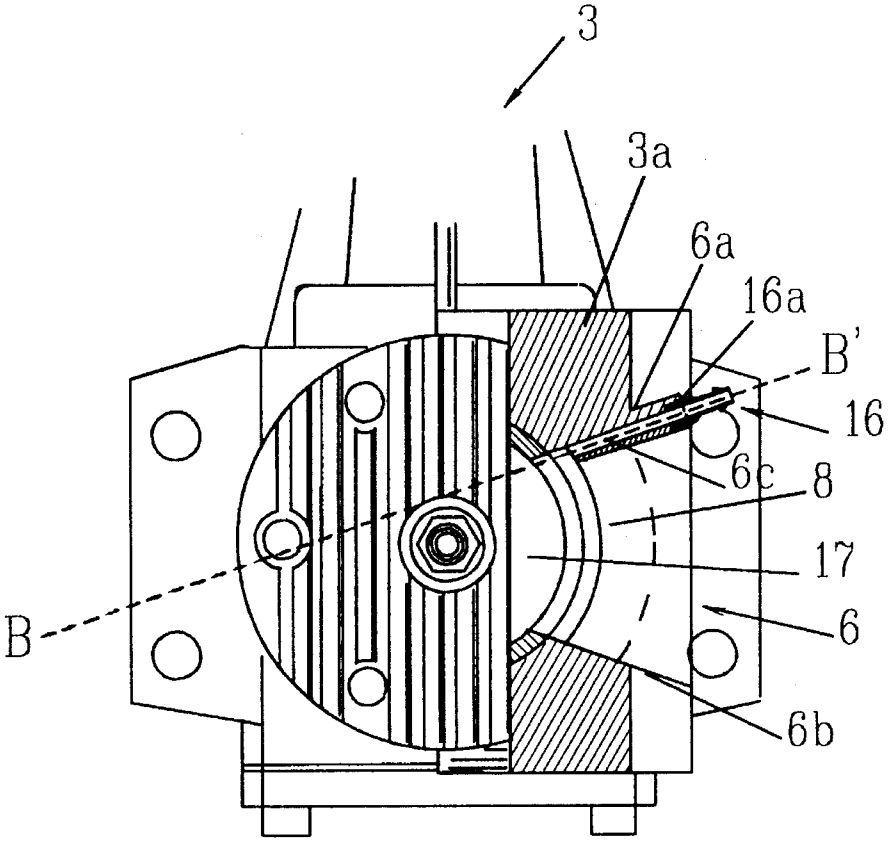
Figure 4B:
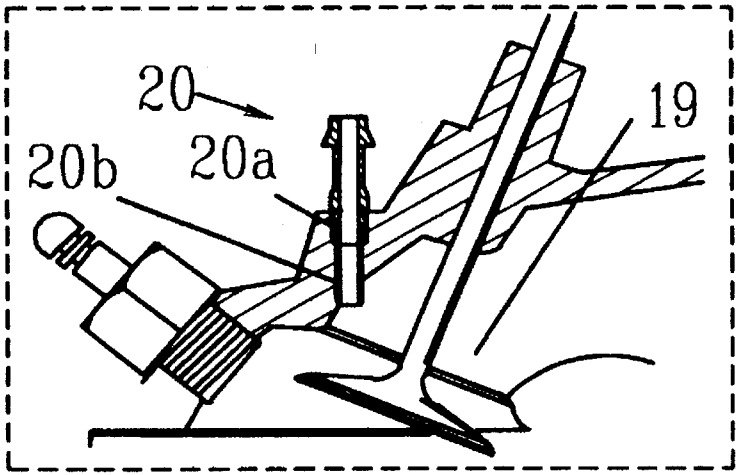
FIG. 4*b* is a closed up view of the exhaust valve area of FIG. 4*a* with the exhaust pressure tap fitting in place in accordance with the principle of this invention.

As discussed, it is highly desirable therefore to increase the exhaust-powered fuel tank pressure to a level sufficiently high to make changes in fuel head pressure in flight negligible, at the same time decreasing the muffler back pressure for more engine power and less overheating. In order to overcome such seemingly contradictory situation, it is necessary to tap onto the engine's exhaust pressure at the point as close to the exhaust port as feasible, before the high pressure exhaust gas has a chance to gain in flow velocity as well as to expand hence losing pressure drastically (according to Bernoulli principle). Referring to FIGS. 3*a* and 3*b*, there is shown a pressure tap fitting 16 with a threaded end 16*a* screwed into a channel 6*c* drilled and threaded at the upper corner of the engine's exhaust conduit 6. The channel 6*c* opens up directly facing the exhaust port 8 and only 2–4 milimeters away from the engine's piston 17. Preferrably, it is better to use the anterior wall 6*a* of the engine exhaust conduit 6 instead of the posterior wall 6*b* because the anterior wall is considerably cooler than the posterior wall, hence less varnish built up within the pressure tap channel 6*c* when fuel containing castor oil is used. Since the engine's outer casing 3*a* (which the exhaust conduit is a part of) is made by casting, it is necessary to make the upper corner of the anterior wall 6*a* of the exhaust conduit 6 sufficiently thick during the casting process in order to incorporate channel 6*c* by drilling afterward. A similar exhaust pressure tap is possible for four-stroke cycle engine, as shown in FIG. 4*b*. In this case, the pressure tap fitting 20 is screwed into a hole bore into the engine's exhaust outflow tract very close to and facing the exhaust port 19 and exhaust valve 18. Fitting 20 is different from the previous pressure tap fitting 16 in that the pressure tap fitting 20 has a tubing portion 20*b* extending below the threaded portion 20*a* in the vicinity of the exhaust port 19 in order to be even closer to the exhaust valve opening.

Figures 1A, 1B, 1C:
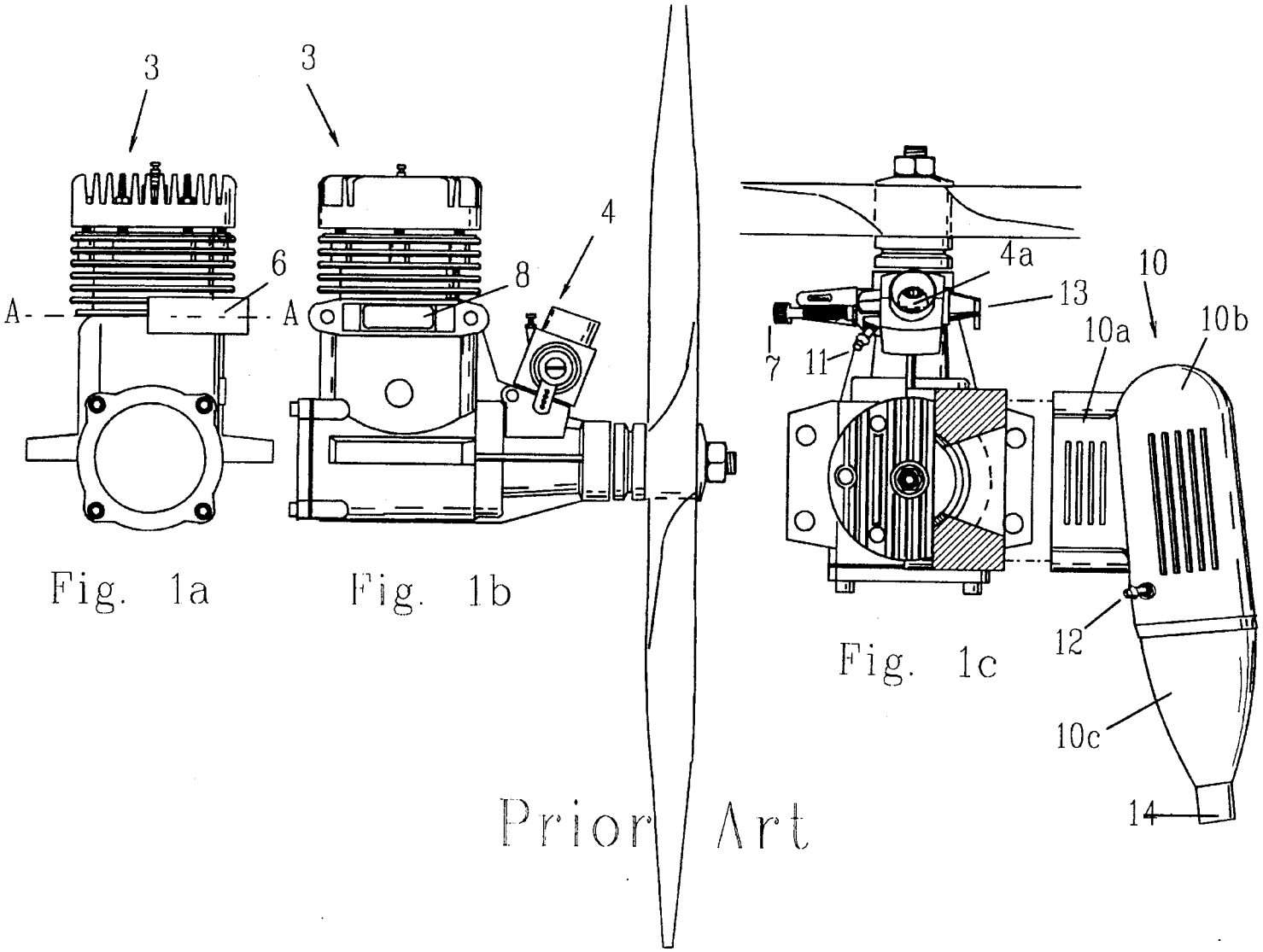
Fig. 1a Prior Art
FIGS. 1*a*, 1*b* and 1*c* are a rear view, a side view and a top-down view respectively of a typical two-stroke cycle model aircraft engine & stock muffler combination which is most predominantly used in the art.
Figure 2:
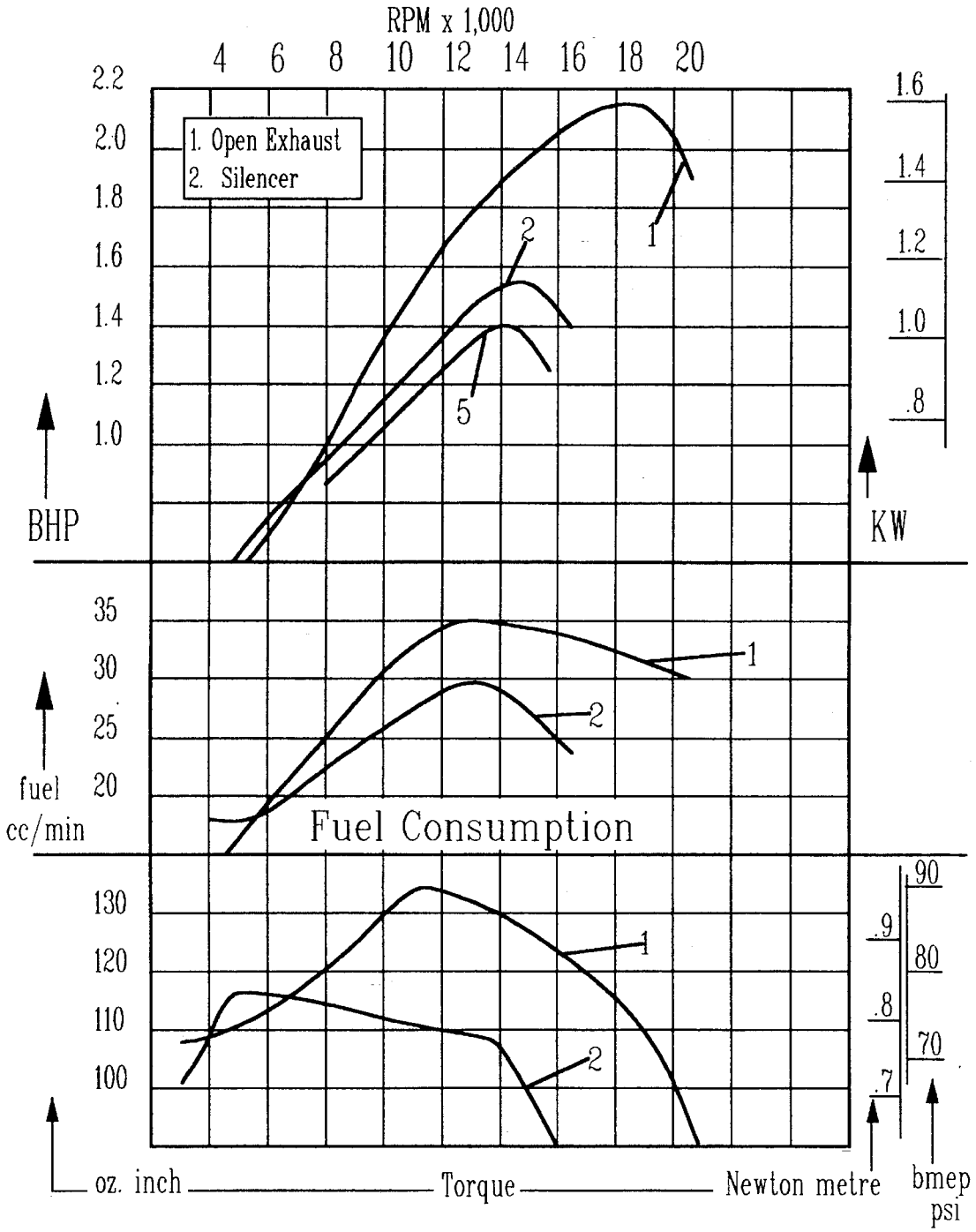
FIG. 2 consists of three graphs from the top down respectively showing variation in horsepower, fuel consumption and torque at different engine rpm for a typical two-stroke glow ignition model aircraft engine.
Figure 5B:
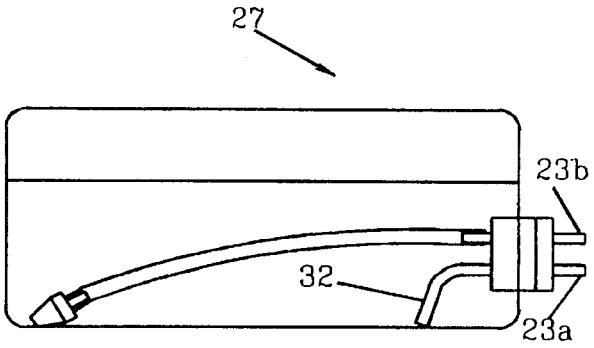
FIG. 5*b* illustrates the reason for fuel venting out of a typical fuel tank that is inverted.
Figure 5A:
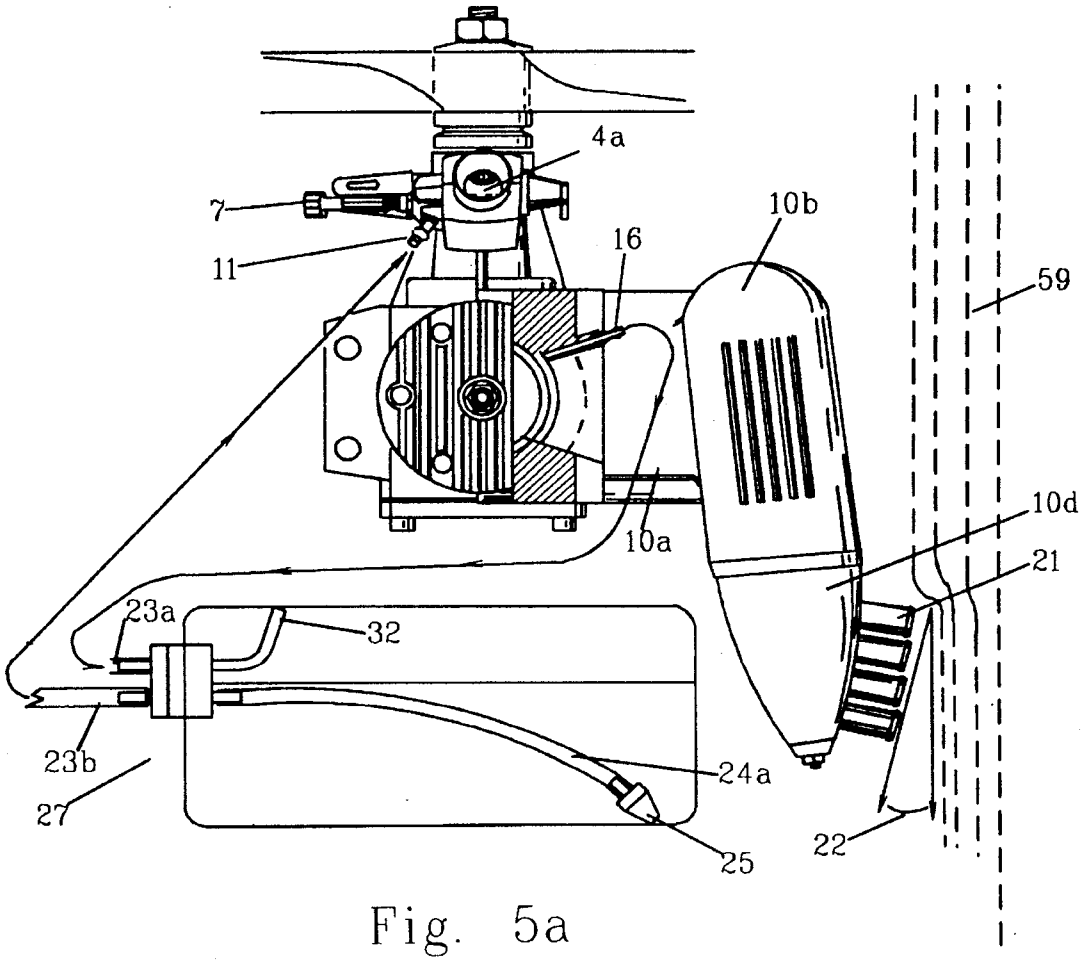
FIG. 5*a* is a diagramatic illustration of a complete tubing connection of all components of the simplest embodiment of this invention.

Referring to FIG. 5*a*, there is illustrated diagramatically a complete tubing connection of all components of this fuel system. Exhaust pressure tap fitting 16 is connected to the fuel tank 27 via flexible tubing attached to the venting/pressurization tubing 23*a* of the fuel tank. Pressure inside the tank will then force the fuel to enter klunk 25 onto flexible tubing 24*a* exiting the tank through the fuel outlet/inlet tubing 23*b* onto another flexible tubing which is connected to carburetor fuel inlet 11 of the engine. The engine is connected to muffler 10, which consist of muffler inlet 10*a*, expansion chamber 10*b*, and tail cone 10*d*. This modified tail cone 10*d* is different from the tail cone 10*c* of prior art in FIG. 1*c* in that there now exist a number of tail pipes 21 in order to greatly reduce the muffler's back-pressure. The tail pipes 21 should preferably be generally perpendicular to the direction of flight in order to allow for aspiration of exhaust gas by the relative motion of surrounding airstream 59 according to venturi effect. The tail pipes 21 may be angled slightly rearward as illustrated by angle 22 when more aspiration is required or angled slightly forward when less aspiration is required. It is important to note that because the aspiration effect is rather weak at the speeds that model aircraft is traveling, the aspiration effect is only significant when the velocity of the exhaust gas in tail pipes 21 is low which is made possible by using tail pipes 21 of large combined cross-sectional area.

In the relative absence of exhaust aspiration effect during operation of the engine, such as when the aircraft is standing still, the pressure inside fuel tank 27 is generally proportional to the rate of exhaust gas production of the engine which is then proportional to the fuel requirement of the engine. When the engine is running at full throttle while standing still, the amount of moving air from the propeller is inadequate for cooling. In addition to this, the relative lugging of the engine when the aircraft not moving make it more prone to detonation. The combination of inadequate cooling with high torque loading necessitate a fuel requirement considerably richer than stoichiometric fuel-air ratio in order to produce peak power and consistent operation. The fuel/air mixture is adjustable prior to take off via needle valve 7. During level flight, more cooling air is available and at the same time torque load decreases as the engine unloads. Therefore, less fuel is required even though the fuel delivery rate is the same causing the engine to run too cool, causing torque to decrease and therefore the engine cannot speeds up in order to deliver its full power potential. (Many model aircraft enthusiasts cannot resist the temptation to lean out the engine on the ground in order to gain more power in the air, often with disastrous consequence of engine quitting or overheat damage during a steep climb or a tight loop.) However, with exhaust gas aspiration at flight speed, the pressure inside muffler 10 decreases, in turn causing a decrease in pressure in fuel tank 27 and thus less fuel delivery in keeping with the lower fuel demand. Thus, the engine can always run at its optimum temperature with the correct fuel-air mixture in the air and in the ground, provided that the degree of exhaust aspiration is calibrated by varying angle 22 until maximum level flight speed is obtained even when larger size propeller is used for higher thrust at lower speed, at the same needle valve setting. Angle 22 may be adjusted referring to FIG. 9*a* by the use of extension tubings 57 attached to muffler tail pipes by flexible silicone rubber hose 56*a*. The tip of extension tubings 57 is covered by a short segment of silicone hose 56*b* and banded together by a thick silicone rubber band 56*c* in order to prevent shear movement (sliding) among the tubings thereby preventing the tubings 57 from excessive rearward flexion when exposed to high air resistance at high airspeed. Should there present bubles in fuel line, or dirt in carburetor jet spray orifice causing the mixture to become too lean, the engine will lose power and the aircraft will slow down, but the engine will not quit because at slower airspeed, more fuel pressure in relation to demands is available to counter act the restriction to fuel flow. In the conventional fuel system in the prior art as discussed earlier, even a small restriction to fuel flow usually is sufficient to cause the engine to quit. In fact, engine quitting while in flight and especially during take off is frequent enough to be a plague in model aviation, and has destroyed an untold number of model aircraft. Since the pressure in tank 27 is much higher in comparison to carburetor venturi fuel draw partial vacuum, it is the predominant motive force in fuel delivery to the engine, and allows the use of larger-bore carburetor for even more power. This type of feed-back fuel metering is adequate to ensure optimum engine operation at all speed and throttle setting even with very simple and inexpensive carburetor. In fact, the carburetor (charge-forming device) needs not be any more than a throttle body containing a throttle valve, a fuel spray jet and a needle valve at the fuel inlet for mixture adjustment.

Because of pressure fluctuation in the fuel tank 27 in response to engine power output, throttling down of the engine will cause the fuel tank 27 to relieve some stored exhaust gas to re-equilibrate with the new pressure level. Referring to FIG. 5*b*, when the fuel tank 27 is inverted during inverted flight (or in a dive), the inside-of-the-tank end 32 of venting/pressurization line 23*a* is submerged in fuel, thus causing a small amount of fuel to be forced back into the engine's exhaust port as the tank 27 is venting during throttling down. At higher than engine idling speed, enough exhaust gas is released by the engine to deflect the back-flow of fuel away from the exhaust port thus engine flooding usually does not occur, unless in very rapid throttling down in a two-stroke engine, in which case the fuel back-flow may be sufficiently strong to penetrate the stream of exhaust gas. Therefore, in practice, it is desirable to raise the engine idle speed setting during flight, and to remember not to throttle down too rapidly while the aircraft is inverted or in a dive.

Making up for the above slight inconvenience, however, (due to the exhaust pressure tap being very close to the exhaust port) is the advantage of automatic exhaust port priming (for two-stroke engine only) with fuel every time the fuel tank is filled. Referring again to FIG. 5*a*, filling of the fuel tank 27 is always done via fuel inlet/outlet 23*b* while air inside the tank is vented via venting/pressurization tube 23*a*. When the tank is full, excess fuel will exit via venting tube 23*a* and into the engine exhaust port, thus priming it with fuel. Care must be taken to avoid flooding of the engine by keeping the exhaust port closed (in warm weather) or only slightly open (in cold weather) during priming. Then, the exhaust port must be pointed in the downward direction to drain off excess fuel, and the engine turned by hand for a few revolutions to wet the combustion chamber with fuel. This way, the engine should always start predictably with one or two turns of hand cranking even in cold weather (32° F. or 0° C.) using the usual alcohol-based fuel without requiring engine priming by more evaporative lighter fluids.

Figures 6A, 6B, 6C, 6D, 6E, 6F:
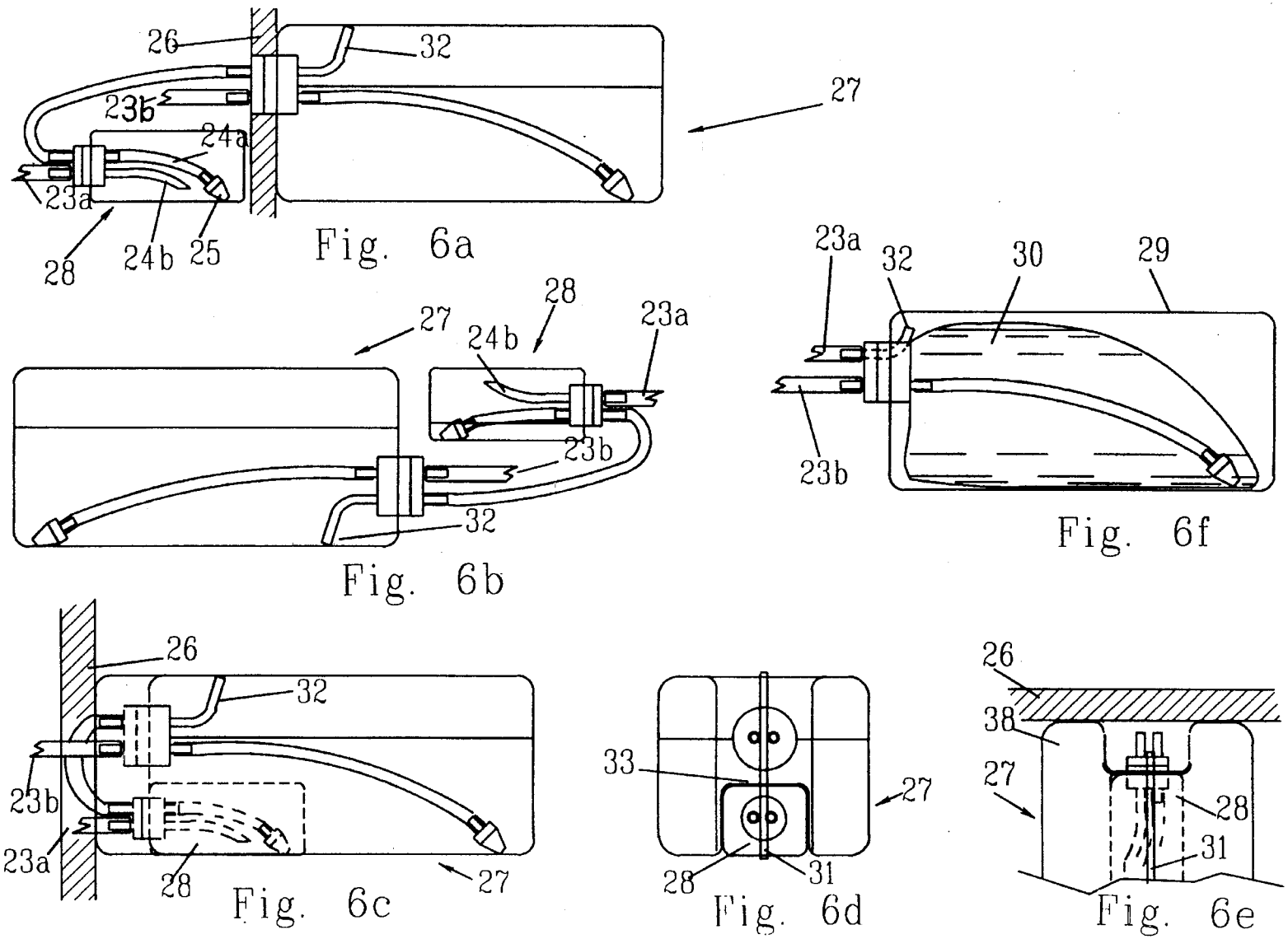
FIGS. 6*a*, 6*b*, 6*c*, 6*d*, 6*e*, and 6*f* represent various embodiments of the fuel-trapping arrangement used to prevent back-flow of fuel vented from the main tank 27 to the engine's exhaust port when the engine is being throttled down while the aircraft is flying inverted.

In order to avoid wasting of expensive fuel during tank venting while inverted and to have a more care-free operation, a small fuel trap tank 28 may be employed, referring to FIG. 6*a* and 6*b*. Fuel vented out of the main tank 27 is collected in trap tank 28 in FIG. 6*b*. Rigid tubing 24*b* is bent in opposite direction to prevent vented fuel from entering venting/pressurization tube 23*a* into the engine's exhaust port. During throttling up, increase pressure inside trap tank 28 will force the trapped fuel into klunk 25 and flexible tubing 24*a* and then onward into main tank 27 thus emptying the fuel trap tank 28. The fuel trap tank 28 may be mounted in the engine compartment in front of aircraft firewall 26 while the main tank 27 is normally mounted directly behind the firewall 26. The fuel trap tank 28 needs only be roughly one tenth the volume of main tank 27.

For model aircraft with too small an engine compartment for mounting of the trap tank in front of the firewall 26, it is particularly convenient to make the main tank 27 and trap tank 28 into one integral unit by making trap tank 28 fit into a molded recess 33 in the main tank 27's wall, referring to FIGS. 6*c*, 6*d*, and 6*e*. Snugly fitted in the recess 33, the trap tank 28 can be removably held in place by a simple string or wire 31 wrapped around main tank 27 as is more clearly illustrated in front-end view in FIG. 6*d*. It is desirable to have forward protrusions 38 on both sides of the front end of main tank 27, as more clearly illustrated in FIG. 6*e*, which is a top-down view, in order to protect the front end of the tank against the firewall 26 as shown in FIG. 6*c* and 6*e*.

Referring to FIG. 6*f*, it is also possible to prevent back flow of fuel into the exhaust port by the use of a commercially available "bubbleless" fuel tank by Tettra Accessories which is available from Hobby Shack in Fountain Valley, Calif. This type of tank is composed of a firm outer shell 29 that houses a collapsible bag 30 containing fuel. This bag collapses gradually as the fuel is consumed and therefore the fuel is kept separately from the exhaust gas or air, thereby preventing buble or foam from forming inside the fuel tank under high engine vibration. Foaming of the fuel is a frequent cause of engine leaning and quitting during flight. Tank pressurization is again via tube 23*a* which, as shown in FIG. 6*f*, is kept away from the fuel. The disadvantage with this type of tanks is that they are currently expensive and that they eliminate the automatic exhaust-port-priming-after-fueling feature of this invention, as mentioned earlier.

Figure 7:
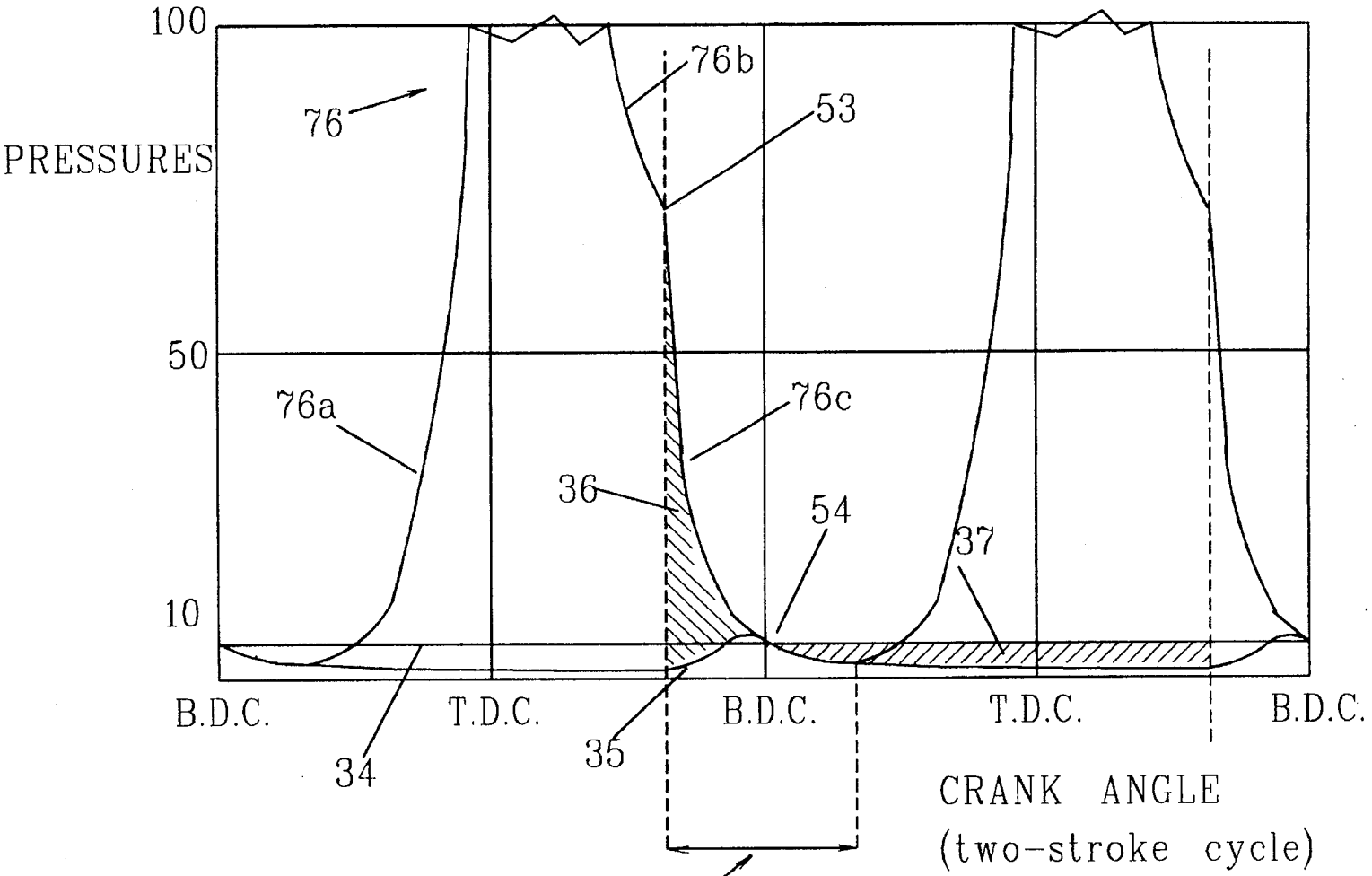
FIG. 7 is a graph showing variation in engine cylinder pressure, fuel tank pressure and muffler pressure throughout the engine operating cycle for a two-stroke cycle engine modified in accordance with this invention.
Figure 8A:
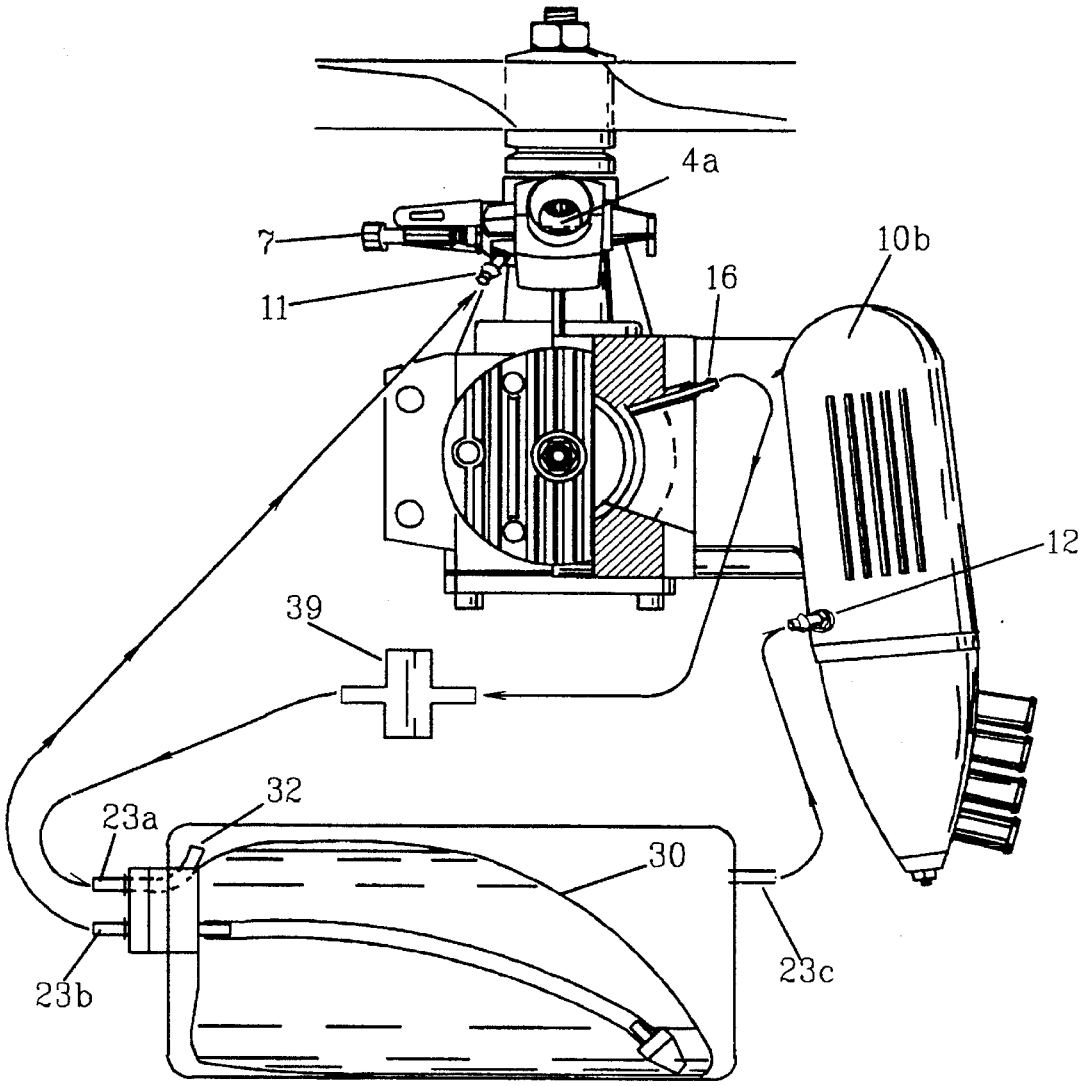
FIG. 8*a* is a diagramatic illustration of the tubing connection of an embodiment of this invention using one-way-flow valve to increase the fuel tank pressure.

In a few application, it is necessary to mount the fuel tank 27 much further away from the firewall 26 (for example, nearer the center of gravity to avoid a shift in the aircraft center of gravity as the tank is emptying). This requires fuel tank pressure several times higher than available with a simple pressure tap as in FIG. 5*a*, in order to make changes in fuel head pressure during drastic flight condition negligible. To obtain higher pressure from the rapidly fluctuating exhaust gas pressure source ordinarily requires a one-way-flow valve (for example, the well-known reed valve used in two-stroke engine induction) between the exhaust pressure tap fitting and the fuel tank. Referring to FIG. 7, this valve will trap the very high exhaust pressure present right after the opening of the exhaust port at point 53, and causing the fuel tank pressure to be also very high. However, when the engine is throttled down resulting in a decrease in fuel consumption, the one-way-flow valve maintains a constantly high pressure inside the fuel tank. Therefore, fuel metering by using the rate of exhaust gas production is not possible, unless, referring to FIG. 8*a*, the fuel tank further comprises of an outlet 23*c* (at the rear) connecting to a lower pressure area (such as the muffler's expansion chamber through nipple fitting 12) to provide for intentional leakage of exhaust gas from said fuel tank. The line tubing connecting the exhaust pressure tap 16 and the one-way-flow valve 39 should be as shod as possible in order to minimize dampening effect at high engine rpm. The lower the rate of exhaust gas leakage through tank outlet 23*c*, the higher the pressure will be in the fuel tank. By controlling the rate of exhaust gas leakage through tank outlet 23*c* with a flow-controlling valve (not shown) and linking this controlling valve to a vacuum actuator (not shown), then the fuel mixture can be made to vary with engine's intake manifold vacuum (or to any other engine condition if other actuators are used besides the vacuum actuator). This level of complexity is rarely practical in model aircraft application. Furthermore, referring to FIG. 5*b*, when the aircraft is inverted, fuel will continously be drained out of the fuel tank with the continous exhaust gas leakage essential for this setup, unless the expensive "bubbleless" Tettra fuel tank is used, referring to FIG. 8*a* or FIG. 6*f*.

It is possible to use a simpler setup with a so-called directionally biased bi-directional flow (DBBDF) valve to allow venting of pressure inside the fuel tank. This valve allows flow in both directions, but offers more resistance to flow in one direction than the other. FIG. 7 illustrates the principle behind this. FIG. 7 is a graph of variation in cylinder pressure 76, variation in fuel tank pressure 34, and variation in muffler pressure 35, throughout the engine operating cycle, from BDC (bottom dead center) to BDC constituting one complete cycle of a two stroke engine. At the point of exhaust port opening 53, cylinder exhaust pressure is high and declines rapidly according to first order kinetics as represented by curve 76*c*. This high exhaust pressure drives a portion of the exhaust gas through the exhaust pressure tap fitting into the fuel tank, with the amount of exhaust gas passing through per unit time interval being proportional to the mean gas pressure for that time interval. Therefore, the amount of exhaust gas passed through the exhaust pressure tap fitting into the fuel tank in one cycle is proportional to the area 36 under curve 76*c*. Beyond point 54 in curve 76*c*, pressure inside the fuel tank exceeds pressure in the region of the exhaust port, and exhaust gas began to flow out of the fuel tank until the exhaust port opening of the next cycle. Because the total volume of exhaust gas flowing in and out of the fuel tank is very small in comparison to the gas volume inside the fuel tank, the fuel tank pressure does not fluctuate by much and is represented by line 34. Meanwhile, the pressure inside the muffler fluctuates widely with each cycle due to the lack of back-pressure and is represented by curve 35. The amount of exhaust gas flowing out of the fuel tank in one cycle is represented by the area 37 between line 34 and curve 35. When the pressure inside the fuel tank has reached equilibrum, then area 36 must be equal to area 37 because the volume of gas flowing into the tank (inward flow) must be equal to the volume of gas flowing out of the tank (outward flow) in one cycle at equilibrum. By knowing the value of area 36, one can determine the magnitude of the pressure represented by line 34, assuming that the resistances to inward flow and outward flow are equal. However, if the resistance to outward flow is x times the resistance to inward flow, then the pressure inside the tank (line 34) must accordingly be x times greater in order to allow for equal amount of gas flowing in each direction at equilibrum.

Figure 8C:
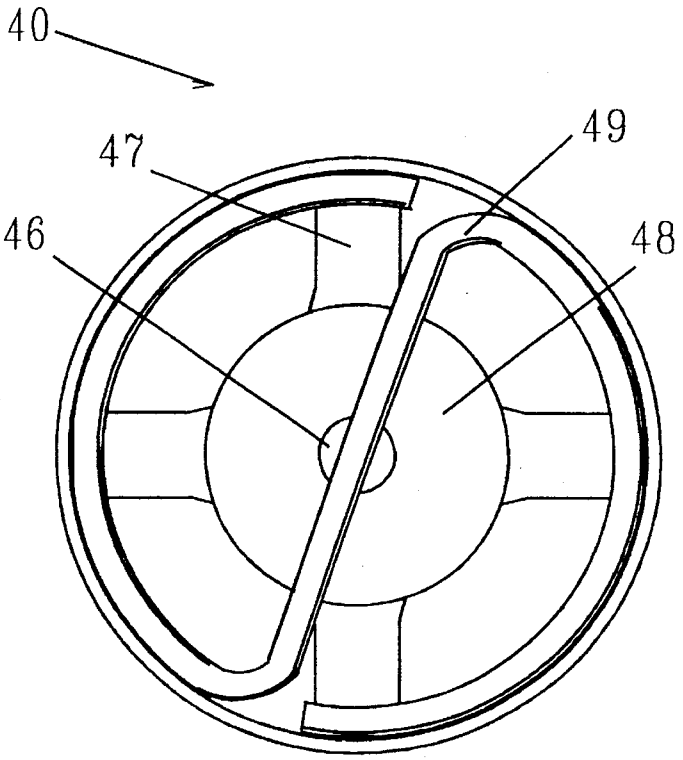
FIGS. 8*b* and 8*c* are longitudinal section view and cross section view respectively of a directionally-biased bi-directional flow valve.
Figure 8B:
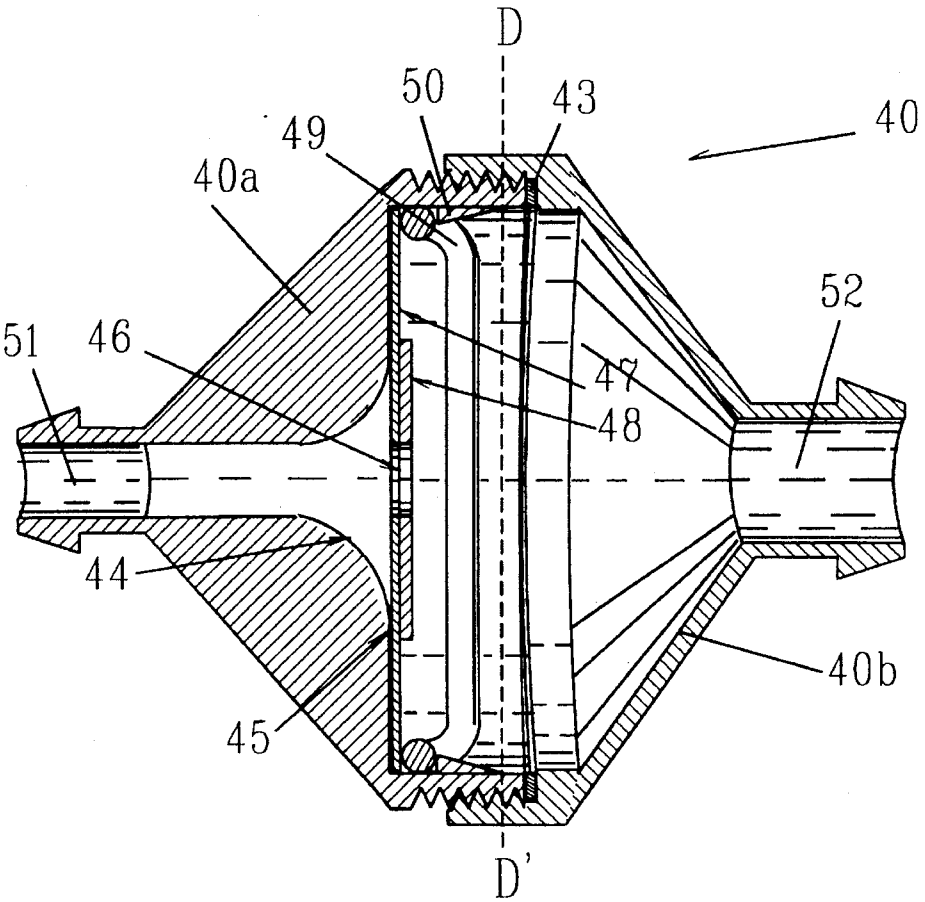

Referring to FIGS. 8*b* and 8*c*, construction of the DBBDF valve is similar to that of a reed valve with the addition of a hole or flow-restricting channel 46 in the middle of the valve's flapper assembly 44. The valve unit 40 has a front half 40*a* and a rear half 40*b* removably attached together by screwing them together and sealed by resilient O-ring 43. The front half 40*a* is connected to the engine's exhaust pressure tap fitting and the rear half 40*b* is connected to the fuel tank. The valve's flapper assembly 44 consist of an elastic portion 47 and a disc shaped portion 48 laminated together to confer rigidity for consistent fit on valve seat 45. Flapper assembly is kept in position by retaining wire 49 which in turn is retained by bevels 50 built into valve unit front half 40*a*.

In operation, high pressure exhaust stream enters inward-flow tract 51 of valve's front half and pushes valve flapper assembly 44 rearward as exhaust gas starts flowing around the valve seat area 45 (and of course through hole or channel 46 as well). Because of relatively large size of flapper disc circumference, there is very little resistance to inward flow of exhaust gas. Shortly thereafter, the exhaust pressure in the exhaust port area decreases and the elastic portion 47 brings flapper assembly 44 to a closed position against valve seat 45, aided by the pressure inside the fuel tank as outward flow begin. Because the flow path around valve seat 45 is now closed, outward flow can only flow out through relatively narrow channel 46. Thus, outward flow's resistance is higher than inward flow's resistance.

Because fuel tank pressure obtained by using DBBDF valve is several times higher than obtained without this valve as in FIG. 5*a*'s simple set up, exhaust gas aspiration by moving airstream is not strong enough to be use to decrease the fuel flow rate at high engine speed. Fortunately, one can take advantage of the fact that these type of reeds valve are known to be inefficient at high frequency of opening-closing cycle due to the inertia of the flapper assembly 44. At low frequency of operation, the flapper assembly moves its full range from completely closed position against valve seat 45 to full open position when it hits retainer wire 49. However, at above a certain frequency, flapper assembly 44's range of movement decreases, such that it neither closes nor open completely, thus unable to seal completely against valve seat 45 during the outward flow portion of the cycle. This seal leakage increases with increase in frequency of operation, and thus cause a relatively progressive decrease in fuel tank pressure with higher engine rpm, starting at a predeterminable engine rpm. Changing the mass of flapper disc 48 will change the inertia of flapper assembly 44 and will allow selection of the frequency in which the valve starts to have seal leakage.

If at low engine speed at small throttle opening the carburetor fuel suction is small in comparison to the fuel tank pressure then the engine may suffer from poor throttle response (due to a small lag time that it takes in raising the fuel tank to higher pressure when throttle is opening up). It is therefore necessary to have fuel tank pressure at low throttle slightly higher with respect to the rate of exhaust gas production than the fuel tank pressure at high throttle in order to permit the carburetor fuel spray orifice to be smaller at low throttle and to open up correspondingly with opening of throttle valve. In this way, as the throttle is rapidly advanced, fuel spray orifice opens up larger thus admitting in more fuel in response to larger air intake, and therefore rapid throttle response. Because of this reason, the engine rpm in which the DBBDF valve starts to have seal leakage should be rather low. In the situation without DBBDF valve as the simple set up in FIG. 5*a*, the carburetor is already designed with proportionally much higher fuel suction at low throttle thereby allowing smaller fuel spray orifice opening at low throttle, which opens up as throttle is advanced hence good throttle response as well.

OTHER SIGNIFICANT EMBODIMENTS AND VARIATIONS

Figures 9A, 9B, 9C:
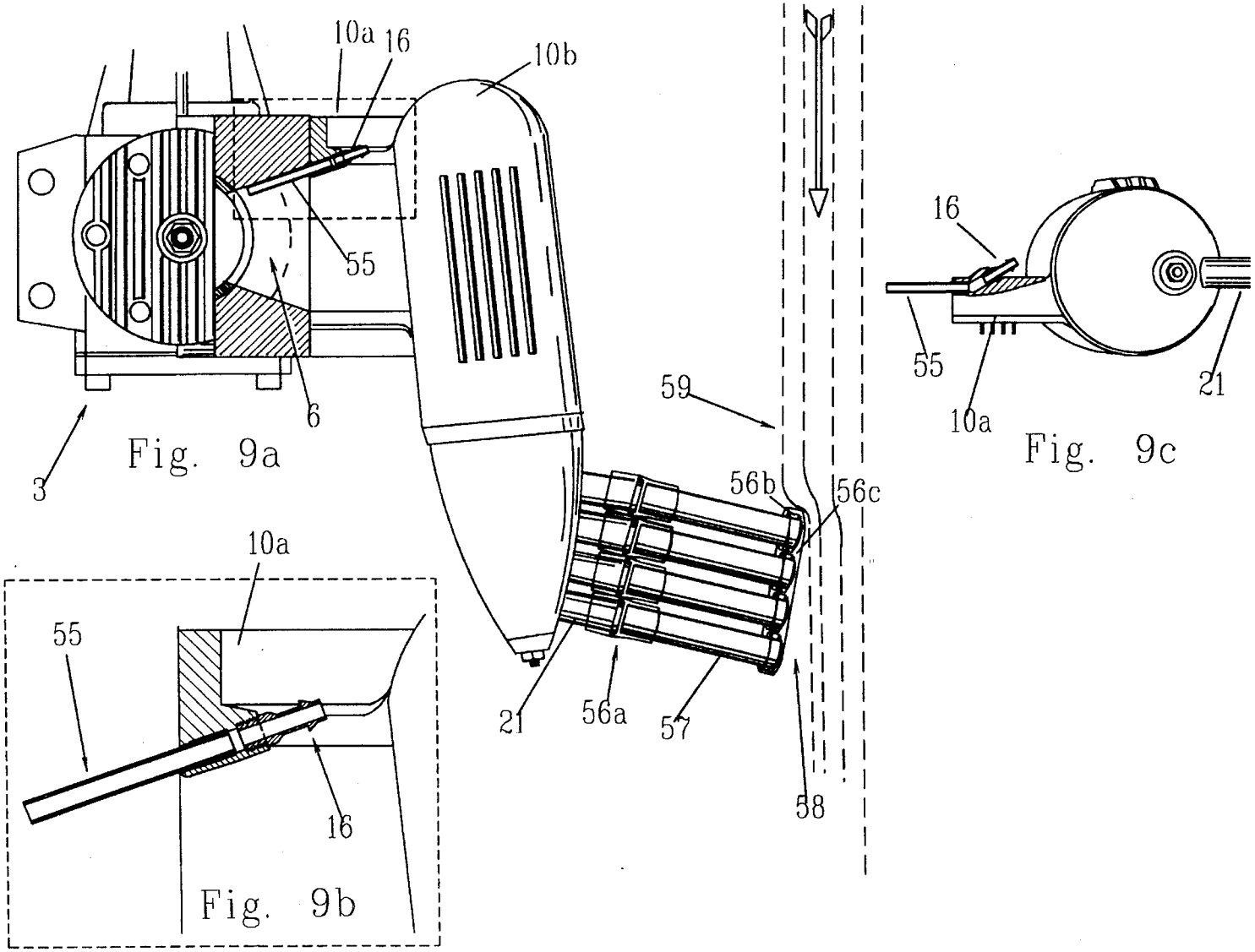
FIG. 9*a* is another embodiment of this invention with the exhaust pressure tap mounted on the muffler itself.
FIG. 9*b* is a close-up top-down view of FIG. 9*a* in the vicinity of the pressure tap.
FIG. 9*c* is a rear eye-level view of the pressure tap of FIG. 9*b*. Part of the muffler has been removed to show details of the exhaust pressure tap in all three FIGS. 9*a*, 9*b* and 9*c*.

Referring to FIG. 9*a*, the exhaust pressure tap fitting 16 may be installed in the muffler inlet 10*a* if desired. In FIG. 9*c*, which is a rear view with a part of ;the muffler inlet 10*a* removed to show internal details, the pressure tap fitting 16 is shown angled upward and outward, and screwed into a channel drilled into the thickened wall of the muffler inlet 10*a*. Fitting 16 is in connection with a rigid tube 55 disposed horizontally. Tube 55 has one end opens up directly facing the exhaust port. Tube 55 has another end which is threaded so that it can be screwed into muffler inlet 10*a*. Alternatively, tube 55 may also be welded to muffler inlet 10*a* after tube 55 is inserted into a horizontal channel in communication with the pressure tap fitting 16. FIG. 9*b* is a close-up top-down view of the pressure tap area. FIG. 9*a* further shows tail pipe extensions 57 attached to muffler tail pipes 21 by flexible silicone hose 56*a* in order to further reduce noise from the muffler and to direct the oily exhaust gas away from the airplane. Tubing extension 57 should preferably have thin wall made from aluminum for good heat transfer and light weight given a normally high engine vibration level. The length of tubing extension 57 is not important, but the longer it is, the more noise attenuation is possible and the cleaner the airplane will be from the messy oily exhaust, with a slight increase in muffler back-pressure. Should more noise attenuation at the expense of engine power and reliability be necessary, a number of tail pipes 21 may be plugged up. The tips of extension tubings 57 are maintained in proper spacing by a short piece of silicone hose 56*b* and the tips are banded together by a tight silicone rubber band 56*c* in order to limit the shear movement (sliding) among the tubes due to rearward force of airstream 59 at high airspeed. Zone 58 is a region of low pressure created by the moving airstream 59.

Figure 10C:
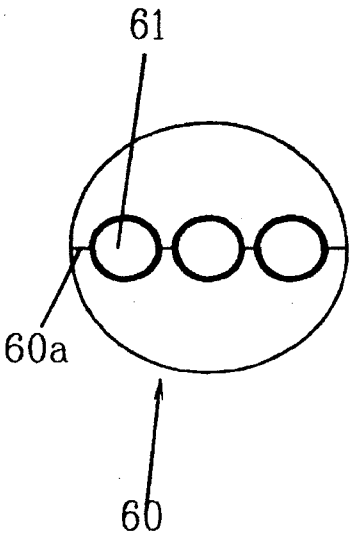
FIGS. 10*a*, 10*b*, and 10*c* are details of a muffler internal baffle that can significantly reduce engine noise with almost no increase in muffler's back-pressure.
Figure 10B:
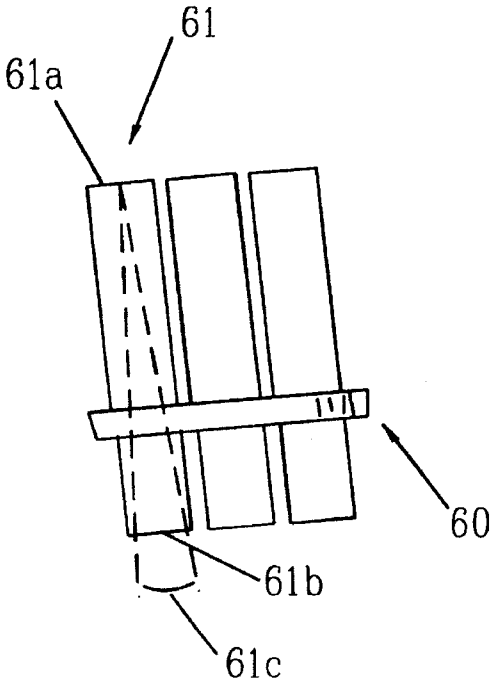
Figure 10A:
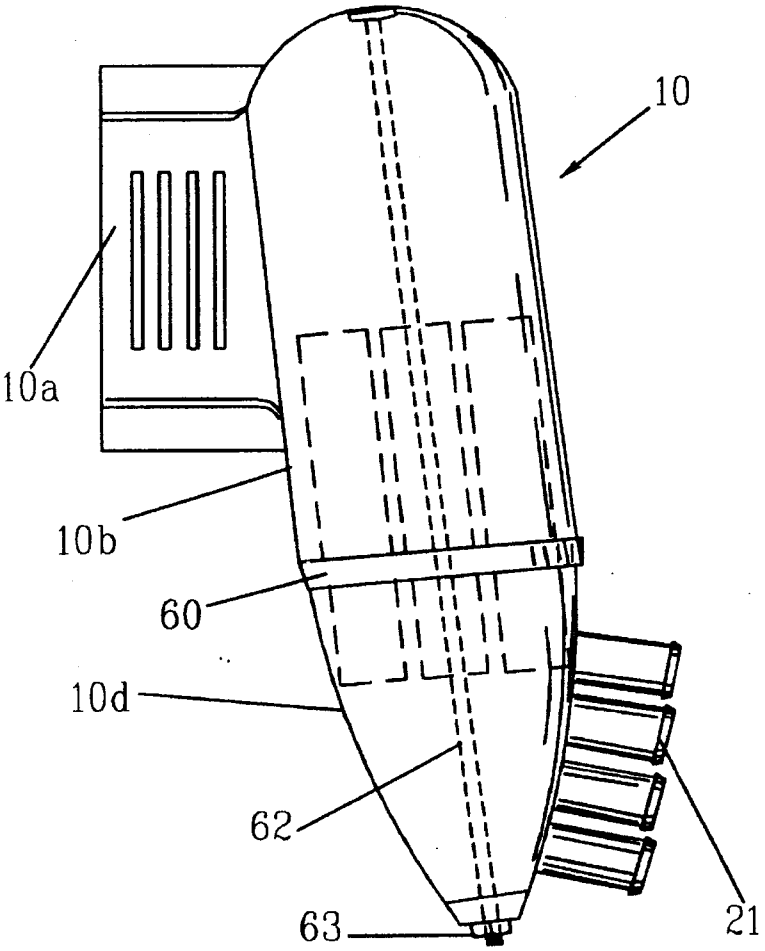

For further noise attenuation without sacrifice in engine power, reliability or fuel economy, larger muffler expansion chamber and/or low resistance muffler baffle may be used. Referring to FIG. 10, baffle plate 60 has a pluriality of metal tubings 61 of significant length for noise suppression. As the sound wave front of audible frequency enters the front end 61*a* of each tube 61, the wave front is broken up into separate wave sources that tends to spread into all directions inside the tube, according to Christian Huygens wave principle. However, because of the tubes' sidewall, the wave undergoes extensive internal reflection, hence exiting the tubes' rear end 61*b* much attenuated, except for a small portion of the wave traveling within the angle 61*c* that passes through unchanged. Therefore, further noise attenuation is possible by having more tubes of smaller diameter (with smaller angle 61*c*), and coming the inside wall of the tubes with sound absorbing material. As long as the combined cross-section areas of tubes 61 is large, then the gas flow velocity through the tubes is low, hence low exhaust back-pressure is possible. For lowering the cost of manufacturing, both baffle plate 60 and tubings 61 may be integrated by casting in the same mold from aluminum, in two halves and joined together across seam 60*a*. Baffle plate 60 is installed in the muffler 10 sandwiched between muffler front half 10*b* and rear half 10*d*. Front half 10*b* and rear half 10*d* are held together by a long bolt 62 and nut 63, so that rear half 10*d* is rotatable with respect to the front half 10*b* thereby allowing exhaust tail pipes 21 to be directed in the desired direction.

When the fuel tank must be mounted very far away from the engine, the variation in fuel head pressure to the engine will be much greater during in-flight maneuvering. Therefore, the fuel tank pressure must correspondingly be very high in order to make such variation in fuel head pressure neglibible. Such a high fuel pressure requires very narrow or restricted fuel passage through the carburetor's needlevalve or fuel spray orifice. Narrow fuel passage is more prone to obstruction due to dust particle or gummy built-up too small to be filtered out. High fuel tank pressures increase the risk of fuel tank leakage. In this situation, it is better to use a fuel pump to suck the fuel up to the pump then feed it to the engine.

Since fuel pump has no fuel metering ability, a common practice is to pump fuel in continous circular loop to the carburetor and to return excess fuel back to the fuel tank, without exerting any significant pump pressure to force the fuel into the carburetor, the carburetor having one line for fuel inlet and another line for exit of excess fuel. The carburetor venturi fuel draw will then aspirate the fuel into the engine, but only the amount of fuel that it desires. Since a doubling of the flow rate of air into a fixed-venturi carburetor will cause a four fold increase in fuel draw ability, this not an ideal fuel metering means for a typical model aircraft engine's carburetor (they all have non-variable venturi bore) as discussed. Therefore, in order to have improved fuel metering ability according to the principle of this invention with this type of fuel pump setting, the fuel tank is also pressurized in the same way as illustrated in FIG. 5*a*, with the difference being that the fuel pump is also in place to assist in the delivery of fuel in a continous fashion into the carburetor and unused fuel back to the fuel tank. The fuel returning line from the carburetor is essential for the carburetor to "feel" changes in fuel tank pressure with respect to change in engine power. The fuel pump therefore only serves to eliminate the effect of variation in fuel head pressure due to in-flight maneuvering.

Figure 11B:
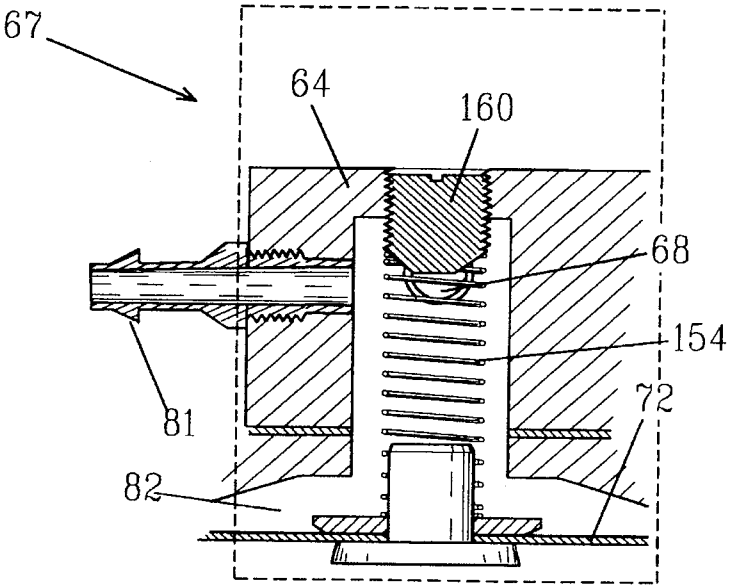
FIG. 11*b* is the closed up view of a modification of the fuel pressure regulator of FIG. 11*a* in keeping with the principle of this invention.
Figure 11A:
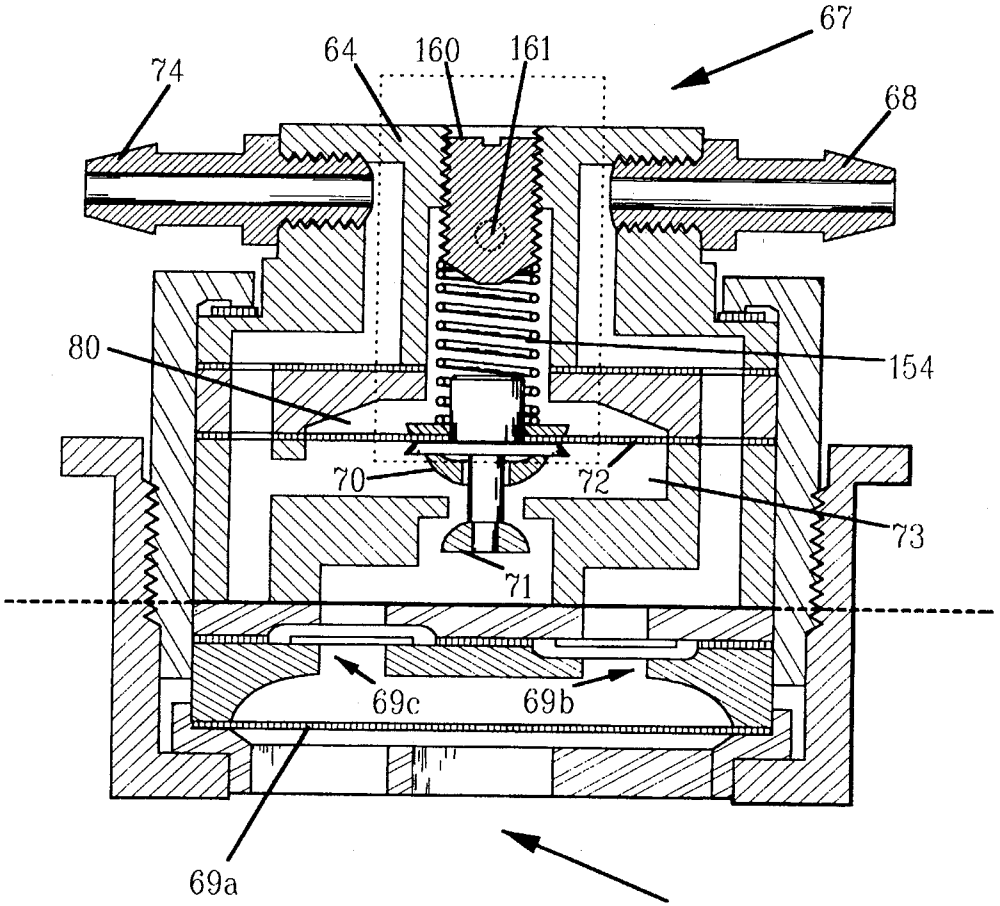
FIG. 11*a* is a longitudinal section view of the integrated Perry's pump/pressure regulator unit in its original form.

When the fuel tank is very large in relation to the engine displacement, it takes too long to get the pressure up or to vent away excess pressure. In some application, the fuel tank should not be pressurized at all. Therefore, another practice using the fuel pump is to leave the fuel tank unpressurized. In this setup, a fuel pressure regulator is mounted near the carburetor and connected to the fuel pump in order to regulate the pressure of fuel being fed into the carburetor. The fuel pressure regulator will maintain a fixed (but adjustable) fuel pressure to the engine, regardless of the pressure generated by the pump itself or variation in fuel head pressure during flight. Since the pressure regulator is not a fuel metering means, the pressure regulator is adjusted to deliver only a low positive fuel pressure to the carburetor thus allowing the carburetor's venturi fuel draw to be the fuel metering means, as with the other type of fuel pump setup. The carburetor however, has only one fuel inlet without fuel outlet line. In order to have the improved fuel metering ability according to this invention, it is necessary to feed the exhaust pressure tapped into the fuel pressure regulator in such a way that the fuel pressure regulator will then deliver to the engine exactly the same amount of fuel pressure as in the exhaust pressure tap. FIG. 11*a* and 11*b* will help illustrate this concept using the example of modified Perry's pump. FIG. 11*a* is a longitudinal section view of Perry's diaphragmatic pump 69 integrated with a pressure regulator unit 67 on top, according to U.S. Pat. No. 3,967,606, wherein further details may be obtained. A bold transverse dotted line in FIG. 11*a* is drawn to conceptually separate regulatory unit 67 from pump unit 69. Briefly, diaphragmatic pump 69 has a diaphragm 69*a* which moves in response to variation in crank case pressure in a single cylinder piston engine. Fuel enters Perry's regulatory unit 67 via inlet nipple fitting 68 and flowing downward through a channel until it is sucked into diaphragmatic pump unit 69 through inlet valve 69*b* and forced out of the pump unit 69 through outlet valve 69*c*. Then, fuel enters through a narrow passage passing the fuel pressure regulating valve head 71 therein and moves further upward pushing open the fuel cut-off valve 70 in order to enter the regulator's fuel chamber 73. (Fuel cut-off valve 70 is forced down into closed position by spring 154 when the engine is not running) As the fuel is filling up the fuel chamber 73, it pushes the regulator's diaphragm 72 upward which pulls along the regulating valve head 71 upward eventually into a closed position against the valve seat. As the regulating valve head 71 is pressed upward against the valve seat, the pressure exerted by pump 69 is cut off from contact with the engine. Thus, the only fuel pressure felt by the engine through fuel outlet nipple 74 is that exerted by spring 154 against regulator's diaphragm 72. As the fuel inside fuel chamber 73 is used up, the regulator's diaphragm 72 moves down under force exerted by spring 154 pushing down valve head 71 from its valve seat in order to admit more fuel into chamber 73, and the cycles continue. The fuel pressure output of Perry's unit 67 is adjustable by turning on adjustment screw 160 which in turn varies the compression on spring 154. The spring-containing chamber 80 on top of diaphragm 72 is vented to atmospheric pressure via vent port 161 as the diaphragm 72 moves up and down.

Figure 4A:
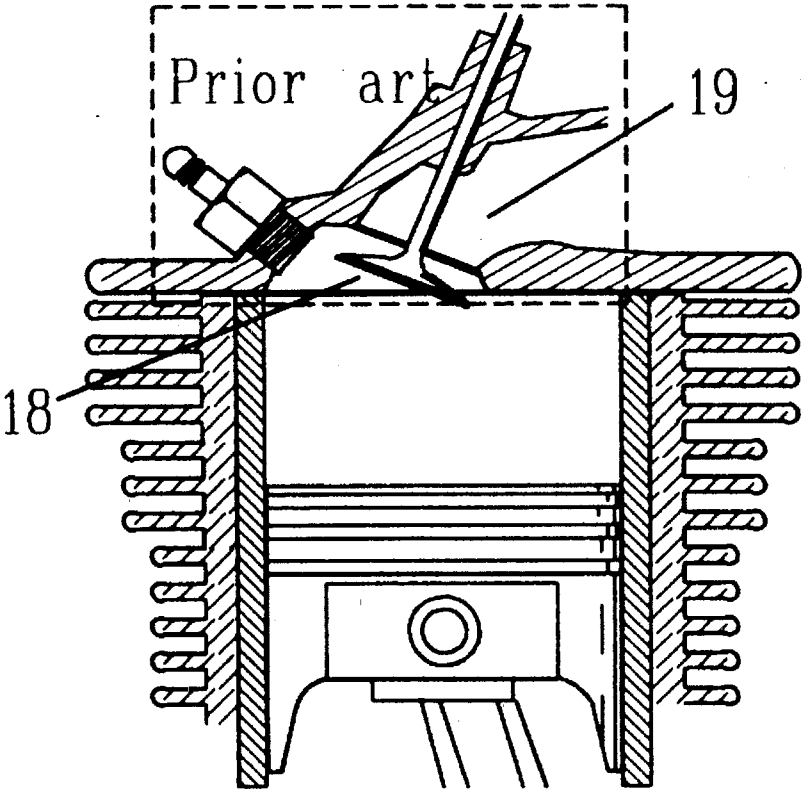
FIG. 4*a* is a saggital-section view of a typical model aircraft four-stroke cycle engine.

From the foregoing, it can be seen that if exhaust pressure is piped into spring chamber 80 of FIG. 11*a*, (turning it into exhaust pressure chamber 82 of FIG. 11*b*) via pressure fitting nipple 81 screwed onto the location of the vent port 161 that is now enlarged and threaded by boring onto regulatory unit's wall 64 at that location, then this pressure will also be exerted against the fuel delivered to the engine. (FIG. 11*b* is closed up view showing modification of spring chamber 80 of FIG. 11*a*, but please note that in FIG. 11*b*, a 90° rotation has occured, with the fuel inlet nipple line 68 is now pointed into the plane of the paper). Since exhaust pressure as obtained by pressure tap according to FIG. 3 or FIG. 4, (alone or in conjunction with the one-way flow valve with controlled leakage or with a DBBDF valve as discussed) has valuable fuel metering property, engine operation will be much enhanced as has been discussed. Spring 154 may be retained if desired, in order to allow for engine priming by cranking prior to starting, and for closure of fuel cut-off valve 70 when the engine is not operating. Spring 154 also gives additional fuel pressure at low engine power at low throttle thus allowing for narrowing of carburetor fuel spray orifice at low throttle. The fuel spray orifice's degree of opening is mechanically coupled to the throttle valve's opening. As throttle is advanced, the carburetor fuel spray orifice is accordingly widened to allow more fuel flowing in, in accompanying with more air intake (before the engine has a chance to built up power with accompanying higher exhaust pressure). This way, throttle response is instantaneous in spite of even a leaner-than-stoichiometric fuel-air mixture ratio. Adjustment screw 160 may also be retained for fine adjustment of fuel mixture at or near idle, if desired. Spring 154 should be relatively soft so that it contributes only a small percentage to the fuel pressure to the engine at high engine power in order to get the most out of exhaust pressure fuel metering. Because of the above fuel metering means, a complex carburetor is not necessary. Instead, the charge forming device may be merely a throttle body containing a throttle valve the degree of opening of which is coupled to the degree of opening of a fuel spray jet.

Thus, the reader will see that the fuel delivery and metering system of the invention provides significant improvement over the prior art in term of high performance, high reliability, lightness in weight, simplicity and low manufacturing cost. Although described in connection with model aircraft engine, it should be noted that the various embodiments and ramifications discussed herein may be applicable to small-size internal combustion engines of all types in all applications when desirable.

While the above description contains many specificities, these should not be construed as limitations on the scope of the invention, but rather as an exemplification on several preferrable embodiments thereof. Many other variations are possible. For example, the higher exhaust pressure tapped as shown in the invention may be used to force smoke-producing liquids into the lower-pressure muffler's expansion chamber in order to produce a dense smoky exhaust contrail to be used in aerobatic demonstration. Since smoke production is dependent on the heat content of exhaust gas, this type of metering is desirable in order to avoid wasting of smoke-producing fluids, besides being far simpler than the typical mechanical smoke fluid pump currently available commercially.

Accordingly, the scope of the invention should be determined not by the embodiments illustrated, but by the appended claims and their legal equivalents.

What is claimed is:

1. For use in combination with an internal combustion engine having an exhaust port, an exhaust conduit wherein resistance to the flow of exhaust gas creates back-pressure to said engine, and an air-intake conduit containing a fuel discharge nozzle, a fuel supply and metering system relying upon exhaust pressure obtained from said exhaust port, comprising:

an exhaust pressure tapping means placed in proximity to and facing toward said exhaust port, thereby resulting in higher exhaust pressure obtainable therefrom than the exhaust back-pressure existing at distances further away from said exhaust port within said exhaust conduit, and, a fuel tank containing a liquid fuel, said fuel tank includes a pressurization/venting tubing line in fluid connection with said exhaust pressure tapping means and a fuel outlet line tubing in fluid connection with said fuel discharge nozzle of the engine, whereby said liquid fuel is fed to said engine under a pressure that varies generally in proportion with variation in rate of exhaust gas production of said engine.

2. The combination of claim 1 further including an exhaust muffler connected to the exhaust port, said muffler comprising:

a muffler inlet portion for receiving exhaust gas from said engine an expansion chamber following said muffler inlet portion for expansion and cooling of exhaust gas, and, a pluriality of tail pipes for exiting of exhaust gas away from said exhaust muffler.

3. The combination of claim 2 wherein the engine receives a steady flow of external cooling fluid at an increase in flow rate proportional to increase in engine rpm and said tail pipes are exposed to the flow of said cooling fluid at a predetermined angle with respect to the direction of the flow of said cooling fluid in order to aspirate the exhaust gas out of said muffler at a desirable rate hence reducing the muffler's exhaust back-pressure, thereby reducing the fuel tank's pressure as the engine increases in rpm as it unloads, which in-turn, appropriately reducing fuel supply to the engine in keeping with lower fuel demand as said engine cools off as it unloads.

4. The combination of claim 1 wherein said exhaust tapping means is directly attached to said engine, onto an exhaust conduit following the exhaust port, comprising:

a portion of a side wall of said exhaust conduit, said portion is of predetermined thickness wherewithin said portion a channel running toward the exhaust port is formed, said channel has a threaded end facing the engine's exterior, a nipple fitting with a threaded end screwed into the threaded end of said channel, thereby allowing a flexible tubing to be attached to said nipple fitting in order to conduct exhaust pressure into said fuel tank.

5. The combination of claim 2 wherein said exhaust pressure tapping means is attached to said muffler, comprising:

a rigid tube attached to said muffler inlet portion in a direction generally parallel to the flow of exhaust gas, said rigid tube has a first end facing toward said exhaust port and is in proximity to said exhaust port, and a second end attached to a sidewall of the muffler inlet portion, and a nipple fitting with one end attached to the muffler inlet portion in a predetermined position and angle that allow said nipple fitting to be in fluid communication with said rigid tube, thereby allowing a flexible tubing to be attached to said nipple fitting in order to conduct exhaust pressure into said fuel tank.

6. The muffler of claim 2 further comprising:

a pluriality of extension tubings each is removably attached to each of said muffler's tail pipes in order to allow for further noise attenuation while directing unwanted exhaust material toward a desirable direction, and removable attachment means for attaching said extension tubings onto said muffler's tail pipes.

7. The muffler of claim 2 wherein further noise attenuation is provided for by at least one baffle plate means placed within said muffler's expansion chamber, said baffle plate means comprising:

a plate of similar cross-sectional shape to said expansion chamber thereby dividing said expansion chamber into a front half and a rear half, a pluriality of tubings inserted through said plate, bringing said front expansion chamber half and rear half thereof into fluid communication, said baffle plate tubings are of predetermined number, length and inner diameter, thereby causing attenuation of sound level as the exhaust gas is flowing through said baffle plate means, and, means for attaching said baffle plate means within said expansion chamber.

8. The system of claim 1 further includes a fuel-trap tank placed serially in fluid communication between the pressurization/venting line of the fuel tank and said exhaust pressure tapping means in order to trap liquid fuel venting out of the fuel tank during rapid throttling-down of the engine, said fuel-trap tank comprising:

a hollow structure with side walls, a top wall and a bottom wall, a pressure-receiving line rigidly formed with an external end and an internal ends thereof, said external end is connected to said exhaust pressure tapping means, and said internal end is placed in proximity to said bottom wall in order to prevent vented fuel from flowing back to the engine's exhaust port during rapid throttling-down of the engine when the fuel tank is inverted, and line tubing means for returning of trapped fuel inside said fuel-trap tank to the fuel tank, said line tubing means connects said fuel-trap tank to the fuel tank's pressurization/venting line in order to allow for returning of trapped fuel back to the fuel tank during throttling-up of the engine.

9. The system of claim 1 further includes a hi-directional flow valve serially connected between said exhaust pressure tapping means and said fuel tank, said flow valve contains means for producing differential resistance with respect to flow direction of exhaust gas, wherein there is caused lower resistance to exhaust gas flow toward said fuel tank than exhaust gas flow away from said fuel tank through said valve, thereby causing a higher pressure accumulation in said fuel tank than when said valve was not used, while still allowing the pressure in said fuel tank to vary generally in proportion to the rate of exhaust gas production of said engine.

10. The valve of claim 9 wherein said means for producing differential resistance comprises:

a valve disc mated with a valve seat, said valve disc is able to move reciprocatingly between an open position when a substantial amount of exhaust gas flows past the valve seat and a closed position when there is no flow past the valve seat, a flow channel having a predetermined resistance to the flow of gas, said flow channel traverses through said valve disc thereby allowing hi-directional flow of exhaust gas past said valve disc when even when said valve disc is in the closed position, returning spring means of predetermined degree of elasticity, said spring means is attached to said valve disc for returning said valve disc to the closed position after said valve disc was forced open by high pressure exhaust flow.

11. The valve of claim 10 wherein said valve disc has a predetermined amount of inertia with respect to said returning spring means' degree of elasticity resulting in said valve disc progressively unable to close completely above a desired frequency of operation, thereby causing a slower rate of increase in the fuel tank pressure with respect to increase in engine speed that can be used to enhance engine operation.

12. The system of claim 1 further includes a one-way flow valve serially connected between said exhaust pressure tapping means and said fuel tank, said flow valve allows exhaust gas to enter said fuel tank but not to exit through said valve, said fuel tank further comprises of a line tubing of predetermined resistance to gas flow connecting to a region of lower pressure than the pressure in said fuel tank in order to provide for controlled escape of exhaust gas from said fuel tank, thereby allowing more pressure accumulating in said fuel tank than when said valve was not used, while still allowing the pressure in said fuel tank to vary generally in proportion with the rate of exhaust gas production of said engine.

13. For use in combination with an internal combustion engine that operates with a fuel tank pressure higher than ambient atmospheric pressure, wherein said fuel tank pressure directly varies with said engine's power output causing potential venting hence wasting of a quantity of fuel during throttling down of said engine, a fuel tank system comprising:

a main fuel tank having a pluriality of side walls, for storage of liquid fuel, said main fuel tank has a line tubing for pressurization/venting, a fuel-trap tank connected to said pressurization/venting line of the main tank for temporary trapping of a quantity of fuel during venting of said main tank, a recess on one of said main tank's walls of such a shape that allows said fuel-trap tank to fit into said main fuel tank, forming an integral unit thereby facilitating installation of said integral unit within a confined space.

14. For use in combination with an internal combustion engine having an exhaust port, an exhaust conduit wherein resistance to the flow of exhaust gas creates back-pressure to said engine, and an air intake conduit containing a fuel discharge nozzle, a fuel delivery and metering system comprising:

a fuel pumping means providing motive power bringing liquid fuel from a fuel reservoir to the engine, an exhaust pressure tapping means placed along said exhaust conduit, a fuel pressure regulating means having a fuel inlet fitting connected to said pumping means and a fuel outlet connected to the engine's fuel discharge nozzle, for regulating an appropriate fuel pressure delivered to the engine, said pressure regulating means having a chamber in fluid connection to said exhaust pressure tapping means whereby variation in exhaust pressure at said exhaust pressure tapping means causes a corresponding variation in the fuel pressure delivered to the engine by said pressure regulating means.

15. The system of claim 14 wherein said exhaust pressure tapping means is placed in proximity to the engine's exhaust port and facing toward said exhaust port thereby resulting in higher exhaust pressure obtainable therefrom than the exhaust back-pressure existing at distances further away from said exhaust port within said exhaust conduit.

16. The system of claim 14 wherein said pressure regulating means comprises:

a fuel chamber forming a part of a passage between and communicating said pumping means and said pressure regulating means' fuel outlet, a regulator diaphragm bounded on one side by said fuel chamber, a valve seat about said passage between said pumping means and fuel chamber, a regulator valve head in said passage between said pumping means and valve seat, means connecting said diaphragm and valve head, whereby fuel pressure in said fuel chamber displaces said diaphragm in a direction to draw said valve head toward said valve seat to restrict fuel flow into said fuel chamber, and an exhaust pressure chamber also bounded by said regulator diaphragm on opposite side of said fuel chamber, said exhaust pressure chamber' is in fluid connection with said exhaust pressure tapping means, thereby exerting the engine's exhaust pressure via said regulator diaphragm onto said fuel chamber in order to deliver to the engine a fuel pressure that vary generally in proportion to the engine's rate of exhaust gas production.

* * * * *